US008343905B2

(12) United States Patent
Gutiérrez et al.

(10) Patent No.: US 8,343,905 B2
(45) Date of Patent: Jan. 1, 2013

(54) DETERGENT COMPOSITION

(75) Inventors: Carmen Ma Pey Gutiérrez, Barcelona (ES); Blanca Nogués López, Barcelona (ES); María José Bermejo Oses, Barcelona (ES); Hiroshi Abe, Barcelona (ES)

(73) Assignee: Kao Corporation, S.A., Barcelona (ES)

( * ) Notice: Subject to any disclaimer, the term of this patent is extended or adjusted under 35 U.S.C. 154(b) by 191 days.

(21) Appl. No.: 12/226,714

(22) PCT Filed: Apr. 3, 2007

(86) PCT No.: PCT/EP2007/053273

§ 371 (c)(1),
(2), (4) Date: Sep. 16, 2009

(87) PCT Pub. No.: WO2007/141067

PCT Pub. Date: Dec. 13, 2007

(65) Prior Publication Data

US 2010/0041576 A1 Feb. 18, 2010

(30) Foreign Application Priority Data

Jun. 7, 2006 (ES) ..... 200601536

(51) Int. Cl.
*C11D 1/04* (2006.01)
*C11D 1/29* (2006.01)
*C11D 1/75* (2006.01)

(52) U.S. Cl. ..... 510/237; 510/427; 510/428; 510/433; 510/503; 510/505; 510/506

(58) Field of Classification Search ..... 510/237, 510/427, 428, 433, 503, 505, 506; 134/25.2
See application file for complete search history.

(56) References Cited

U.S. PATENT DOCUMENTS 5,575,864 A * 11/1996 Haley et al. ..... 134/42
5,837,065 A * 11/1998 Haley et al. ..... 134/42

FOREIGN PATENT DOCUMENTS

| | | | |
|---|---|---|---|
| DE | 4233385 | | 10/1992 |
| EP | 0580263 | | 7/1993 |
| EP | 0994178 | A1 | 4/2000 |
| GB | 22925562 | | 7/1994 |
| WO | WO94/12608 | * | 6/1994 |
| WO | WO9520027 | | 7/1995 |

OTHER PUBLICATIONS

International Search Report issued by the International Searching Authority (ISA/EP) on Jun. 19, 2007 in connection with International Application No. PCT/EP2007/053273.
WO 94/12608 A (Procter & Gamble) Jun. 9, 1994.
Written Opinion of the International Searching Authority, issued Dec. 10, 2008 in connection with U.S. Appl. No. 12/226,714, filed Oct. 23, 2008.
Search Report issued in connection with the Spanish priority documents of the subject application (P200601536), (Feb. 2008).

* cited by examiner

*Primary Examiner* — Gregory Delcotto
(74) *Attorney, Agent, or Firm* — Gary J. Gershik; Cooper & Dunham LLP

(57) ABSTRACT

The present invention relates to an aqueous detergent composition comprising the following elements in the indicated amounts expressed as percentage by weight: a) 0.1-15% of at least one alkyl ether carboxylate of formula (I): R—O—$(CH_2CH_2O)_m$—$CH_2$—COOX wherein, —R represents a linear or branched, saturated or unsaturated alkyl or alkenyl group containing between 3 and 10 carbon atoms, —m represents a number comprised between 0.5 and 20, and —X represents hydrogen or a suitable cation, selected from an alkaline metal, an alkaline earth metal, ammonium, alkylamino, alkanolamino or glucammonium, b) 0.1-15% of at least one amine oxide, c) 0.1-40% of at least one alkyl ether sulfate type anionic surfactant with a hydrocarbon chain containing between 10 and 18 carbon atoms, d) water up to 100%; said detergent composition is particularly suitable for manual dishwashing, for washing kitchen utensils, as well as in certain domestic cleaning applications of general use, such as the cleaning of hard surfaces.

19 Claims, No Drawings

DETERGENT COMPOSITION

This application is a §371 national stage of PCT International Application No. PCT/EP2007/053273, filed Apr. 3, 2007, and claims priority of Spanish Patent Application No. P200601536, filed Jun. 7, 2006, the contents of all of which are hereby incorporated by reference into this application.

FIELD OF THE ART

The present invention relates to an aqueous detergent composition comprising alkyl ether carboxylates, amine oxides and at least one anionic surfactant of the alkyl ether sulfate type.

Said detergent composition is particularly suitable for manual dishwashing, for washing kitchen utensils, as well as in certain domestic cleaning applications of general use, such as the cleaning of hard surfaces.

PRIOR STATE OF THE ART

Most known detergent compounds use anionic, amphoteric and/or non-ionic type surfactants to obtain an end product showing satisfactory properties in terms of detergency and foam profile. Nevertheless, most of these compounds are generally unsatisfactory as regards the problem of ecotoxicity and irritation in eyes and skin.

On the other hand, in a large number of applications in which surfactants are used, consumers seek a large amount of foaming. For example, a shampoo that does not produce stable, creamy foam during the washing process is expected not to be well accepted in the market. The same applies to manual dishwashing, even when a direct relationship cannot be established between the foaming power and cleaning efficacy.

The main characteristics of the surfactant formulations related to foam which determine their use in areas such as personal hygiene and domestic cleaning, the food sector, the sectors of fire fighting, mineral flotation and many others are: foaming capability, foam stability (the foam remaining after a period of time), foam quantity (associated to a good cleaning effect), foam creaminess (associated to a conditioning effect), foam density, foam texture and foaming speed (foam produced after a very short period of time). On the other hand, it is desirable that the foam is quickly produced (after a few seconds, for example). Furthermore, the foam must further tolerate hard water and the presence of oil and/or greases.

The number of combinations of surfactant which solve this complex requirement tends to be small, which explains why the same formulations are always on the market. One way of overcoming this problem would be to incorporate additives known as foaming amplifiers or reinforcers.

On the other hand, liquid detergent compositions for manual dishwashing, also denominated light-duty liquid (LDL) detergent compositions are well known in the art. Such products are generally formulated to provide very diverse aesthetic and performance characteristics and properties. Firstly and more notably, the products for washing dishes must be formulated with types and amounts of surfactants and other cleaning adjuvants offering an acceptable solubilization and elimination of food stains, especially the oil stains on the dishes to be cleaned with, or in the aqueous solutions formed from said products.

Apart from being suitable for washing dishes, the LDL or gel compositions will also desirably have other features improving the aesthetics or the perception that the consumer has of the efficiency of the manual dishwashing operation.

Therefore, the useful liquids or gels for manual dishwashing must also use materials improving the foaming features (soaping) of the washing solutions formed from said products. The foaming performance includes both the production of a suitable amount of foam in the washing water initially, as well as the formation of foam lasting well in the dish washing process.

The washing liquids or gels for manual dishwashing must also use materials improving the phase stability of the product at low temperatures. The absence of phase stability can give rise to unacceptable Theological and aesthetic properties, as well as performance problems. The liquids and gels for manual dishwashing must further use materials improving the dissolution or mixing speed of the product with water. The liquids and gels for washing dishes must further use materials improving the tolerance of the system to hardness, especially for preventing the precipitation of calcium salts from anionic surfactants. It is known that the precipitation of calcium salts from anionic surfactants causes foam suppression and skin irritation.

On the other hand, the detergent compositions containing alkyl ether carboxylates, amine oxides and an anionic surfactant are well known by persons skilled in the art.

Patent application GB-A-2219594 thus describes a liquid detergent composition comprising, expressed as percentage by weight, a) 10-40% of an anionic surfactant selected from polyoxyethylene alkyl ether sulfate, alkylbenzene sulfonate, α-olefin sulfonate, alkane sulfonate and polyoxyethylene alkyl ether carboxylate,
b) 0.5-10% of a tertiary amine oxide,
c) 0.5-10% of a propylene oxide adduct of a polyhydric alcohol, and
d) 0.5-10% of a sulfobetaine.

According to the description of GB-A-2219594, said composition is transparent and has an excellent detergent and foaming capability, as well as good stability at low temperature. The examples of the mentioned patent application GB-A-2219594 describe sodium polyoxyethylene (3) dodecyl ether carboxylate, although only in combination with dodecyldimethylamine oxide, and dodecylhydroxy sulfo-betaine.

On the other hand, patent application DE-A-4233385 describes a body-cleansing aqueous liquid composition comprising, expressed as percentage by weight, 5-50% of sulfate, sulfonate or alkyl phosphate type anionic surfactant and a mixture of a) 0.1-5% of at least one alkyl polyether carboxylic acid or its salts of formula $$R—(CH_2CH_2O)n—O—CH_2—COOX$$

in which R is a $C_8$-$C_{20}$ alkyl group, n is a number comprised between 2 and 20, and X is hydrogen, an alkaline or alkaline earth metal or an alkyl ammonium or alkanolammonium group,
b) 0.25-5% of at least one amine oxide surfactant and
c) 0.1-5% of at least one amphoteric surfactant.

Optionally, the composition also comprises alkylpolyglucosides. The examples of the mentioned patent application DE-A-4233385 describe a shower gel comprising 20% by weight of sodium lauryl ether sulfate, 2.5% by weight of lauryldimethylamine oxide, and 2.5% by weight of magnesium $C_{12}$-$C_{14}$ alkyl ether (10 EO) carboxylate, among other ingredients.

Patent application WO-A-9520025 describes detergent compositions that produce low sudsing and spontaneously emulsify greases, comprising, expressed as percentage by weight, a) 5-99% of a branched carboxylated type detergent surfactant selected from $C_{12}$-$C_{16}$ alkyl ethoxy carboxylates and $C_{11}$-$C_{20}$ secondary soap, preferably $C_{11}$-$C_{13}$ secondary soap, b) 0.1-40% of a $C_{10}$-$C_{22}$ amine oxide.

As indicated in patent application WO-A-9520025, the alkyl ethoxy carboxylates are compounds of formula $$R—O—(CH_2CH_2O)_x—CH_2—COO\text{-}M+$$

where R is a $C_{12}$-$C_{16}$ alkyl group, preferably $C_{12}$-$C_{14}$ alkyl, x is a number comprised between 3 and 10, preferably between 4 and 10, and M is a cation preferably selected from an alkaline metal, ammonium, mono-, di- and triethanolammonium, more preferably sodium, potassium, ammonium or a mixture thereof. The examples of the mentioned patent application WO-A-9520025 describe low sudsing compositions comprising $C_{12}$-$C_{13}$ amine oxide and alkyl ethoxy (1-3) carboxylates.

On the other hand, patent application WO-A-9520027 describes detergent compositions that produce high sudsing and spontaneously emulsify grease in liquid or gel form, comprising, expressed as percentage by weight, a) 5-99% of a detergent surfactant selected from the polyhydroxy fatty acid amides; fatty alkylpolyglucosides; $C_8$-$C_{22}$ alkyl sulfates; $C_9$-$C_{15}$ alkylbenzene sulfonates; $C_8$-$C_{22}$ alkyl ether sulfates; $C_8$-$C_{22}$ olefin sulfonates; $C_8$-$C_{22}$ paraffin sulfates; $C_8$-$C_{22}$ alkyl glyceryl ether sulfates; fatty acid ester sulfonates; secondary alcohol sulfates; $C_{12}$-$C_{16}$ alkyl ether carboxylates, ampholytic surfactants; zwitterionic surfactants, and mixtures thereof, and b) 8-30% of a $C_{10}$-$C_{22}$ amine oxide, in which the pH is comprised between 6 and 10 and the ratio between amine oxide and surfactant is comprised between 2:1 and 1:4.

The alkyl ethoxy carboxylates described in patent application WO-A-9520027 are the same as those described in patent application WO-A-9520025.

Finally, patent application GB-A-2292562 describes liquid detergent compositions comprising, expressed as percentage by weight, a) 0.5-50% of one or more anionic or non-ionic surfactants or mixtures thereof selected from $C_{11}$-$C_{24}$ sulfonates, $C_{11}$-$C_{24}$ alkyl or hydroxyalkyl alkoxylated sulfates having from 1 to 15 alkoxy groups, alkylpolysaccharides and polyhydroxy fatty acid amides, and b) 0.1-20% of an amine oxide mixture.

According to that described in patent application GB-A-2292562, said detergent compositions can include alkyl ethoxy carboxylates. Said alkyl ethoxy carboxylates are the same as those described in patent applications WO-A-9520025 and WO-A-9520027.

The examples of the mentioned patent application GB-A-2292562 describe liquid detergent compositions comprising i) 17% by weight of $C_{12}$-$C_{13}$ alkyl ethoxy sulfate ii) 2% by weight of $C_{12}$-$C_{14}$ alkyl amine oxide iii) 7% by weight of $C_8$ alkyl amine oxide iv) 0.5% by weight of $C_{12}$-$C_{14}$ alkyl dimethylamine oxide v) 2.0% by weight of $C_{12}$-$C_{14}$ alkyl ethoxy carboxylates among other ingredients.

In spite of the fact that the compositions described in GB-A-2219594, DE-A-4233385, WO-A-9520025, WO-A-9520027 and in GB-A-2292562 display a certain foaming power, a higher and/or more stable foaming is required in certain cases.

DESCRIPTION OF THE INVENTION

The present invention provides an efficient solution to the problems mentioned in the state of the art, providing an aqueous detergent composition comprising, in the indicated amounts expressed as percentage by weight, the following elements:

a) 0.1-15% of at least one alkyl ether carboxylate of formula (I)

$$R—O—(CH_2CH_2O)_m—CH_2—COOX \quad (I)$$

wherein

R represents a linear or branched, saturated or unsaturated alkyl or alkenyl group containing between 3 and 10 carbon atoms, m represents a number comprised between 0.5 and 20, and X represents hydrogen or a suitable cation, selected from an alkaline metal, an alkaline earth metal, ammonium, alkyl amino, alkanolamino or glucammonium, b) 0.1-15% of at least one amine oxide, c) 0.1-40% of at least one alkyl ether sulfate type anionic surfactant with a hydrocarbon chain containing between 10 and 18 carbon atoms, d) water up to 100%.

The use of said detergent composition for manual dishwashing or for cleaning hard surfaces is also part of the object of the invention.

Another part of the object of the invention is the use of at least one alkyl ether carboxylate of formula (I)

$$R—O—(CH_2CH_2O)_m—CH_2—COOX \quad (I)$$

where

R represents a linear or branched, saturated or unsaturated alkyl or alkenyl group containing between 3 and 10 carbon atoms, m represents a number comprised between 0.5 and 20, and X represents hydrogen or a suitable cation, selected from an alkaline metal, an alkaline earth metal, ammonium, alkyl amino, alkanolamino or glucammonium, as a foaming amplifying or promoting agent in detergent compositions for manual dishwashing or for cleaning hard surfaces.

DETAILED DESCRIPTION OF THE INVENTION

Alkyl Ether Carboxylates

Alkyl ether carboxylates are well known products in the art. They are usually obtained from the alkoxylation and subsequent carboxymethylation of fatty alcohols as described by Meijer and Smid in Polyether Carboxylates; Anionic Surfactants; Surfactant Science Series, Vol. 56 (p. 313-361), published by Helmut W. Stache, ISBN: 0-8247-9394-3.

The obtaining process consists of two steps, the first step being the reaction of an alcohol having a hydrocarbon chain of the desired length with ethylene oxide under normal reaction conditions known by a person skilled in the art. On the other hand, a previously ethoxylated alcohol can be used. The ethoxylated alcohol is then reacted with a strong base, for example NaOH, KOH or $NaOCH_3$ in the presence of a reducing agent such as sodium borohydride, to form the corresponding alkoxylate. This product is reacted with sodium monochloroacetate to form the corresponding alkyl ether carboxylate in the salt form. Said salt is converted into the corresponding acid by means of a sulfuric acid wash. Alkyl ether carboxylates with a wide polyoxyethylene distribution (wide degree of ethoxylation) are obtained by means of this process.

For special applications, the ethoxylation can be catalyzed by means of a Lewis acid or by means of metallic Na or NaH to obtain a narrow polyoxyethylene distribution (narrow degree of ethoxylation).

On the other hand, alkyl ether carboxylates can further be obtained as described in European patent application EP-A-0580263.

According to the invention, in the alkyl ether carboxylates of general formula (I), R is preferably a linear or branched, saturated or unsaturated alkyl or alkenyl group containing between 3 and 9 carbon atoms, more preferably between 5 and 7 carbon atoms.

The alkyl ether carboxylates of general formula (I) in which m is a number comprised between 1 and 15, more preferably between 1 and 10, even more preferably between 3 and 9, are also preferred.

Finally, the alkyl ether carboxylates of general formula (I) in which X is hydrogen or an alkaline metal are also preferred.

The total content of alkyl ether carboxylates of formula (I) in the detergent compositions of the invention can be comprised between 0.1% and 15% by weight, preferably between 0.5% and 10% by weight, even more preferably between 1% and 7% by weight with respect to the total weight of the composition.

Examples of commercially available alkyl ether carboxylates of formula (I) are those with commercial references AKYPO® LF1 (INCI name Capryleth-6 Carboxylic Acid), AKYPO® LF2 (INCI name Capryleth-6 Carboxylic Acid), AKYPO® LF4 (INCI name Capryleth-9 Carboxylic Acid+Hexeth-4 Carboxylic Acid) and AKYPO® LF6 (INCI name Capryleth-9 Carboxylic Acid+Buteth-2 Carboxylic Acid), all of them marketed by KAO Chemicals Europe.

Amine Oxide

Suitable amine oxides according to the present invention are amine oxides with a hydrocarbon chain containing between 8 and 18 carbon atoms. The amine oxides of formula (II) are especially preferred

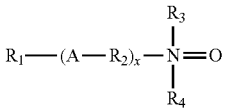

(II)

wherein $R_1$ represents a linear or branched, saturated or unsaturated alkyl or alkenyl group containing between 8 and 18 carbon atoms, $R_2$ represents an alkylene group containing between 1 and 6 carbon atoms, A represents a group selected from —COO—, —CONH—, —OC(O)— and —NHCO—, x represents 0 or 1, and $R_3$ and $R_4$ independently of one another represent an alkyl or hydroxyalkyl group containing between 1 and 3 carbon atoms.

According to the invention, in the amine oxides of general formula (II), $R_1$ is preferably an alkyl or alkenyl group containing between 10 and 16 carbon atoms, preferably an alkyl or alkenyl group containing between 10 and 14 carbon atoms, more preferably a lauric group (12 carbon atoms) and/or a myristic group (14 carbon atoms).

Amine oxides of general formula (II), in which A is a —COO— or —CONH— group, more preferably —CONH—, are also preferred.

$R_2$ is also preferably a methylene (—$CH_2$—) or ethylene (—$CH_2$—$CH_2$—) group. $R_3$ and $R_4$ are also preferably each a methyl group.

The total content of amine oxides in the detergent compositions of the invention can be comprised between 0.1% and 15% by weight, preferably between 0.5% and 10% by weight, even more preferably between 1% and 7% by weight with respect to the total weight of the composition.

Examples of commercially available amine oxides of formula (II) are those with the commercial reference OXIDET® DM-20 (INCI name Lauramine Oxide), OXIDET® DMCLD (INCI name Cocamine Oxide), OXIDET® DM-246 (INCI name Cocamine Oxide), OXIDET® DM-4 (INCI name Myristamine Oxide), OXIDET® L-75 (INCI name Cocamidopropylamine Oxide), all of them marketed by KAO Chemicals Europe.

Alkyl Ether Sulfate

Metal salts of alkyl ether sulfates as well as ammonium salts or organic amine salts with alkyl or hydroxyalkyl substituents can be used as said alkyl ether sulfate type anionic surfactants with a hydrocarbon chain containing between 10 and 18 carbon atoms.

Sodium alkyl ether sulfates with an average degree of ethoxylation comprised between 0.5 and 7, with an alkyl or alkenyl chain containing between 10 and 18 carbon atoms, are preferred as alkyl ether sulfate type surfactants, more preferably with an average degree of ethoxylation comprised between 1 and 5, with an alkyl or alkenyl chain containing between 12 and 16 carbon atoms.

Sodium lauryl ether sulfate (INCI name Sodium Laureth Sulfate) preferably with an average degree of ethoxylation comprised between 1 and 3, is particularly preferred as an anionic surfactant, more preferably between 1 and 2.5, more preferably between 2 and 2.5.

The total content of alkyl ether sulfate type anionic surfactant in the detergent compositions of the invention can be comprised between 0.1% and 40% by weight, preferably between 5% and 40% by weight, even more preferably between 10% and 35% by weight with respect to the total weight of the composition.

Examples of commercially available alkyl ether sulfate type anionic surfactants are those with the commercial reference EMAL® 270D or EMAL® 270E (INCI name Sodium Laureth Sulfate), containing 70% active ingredient and with an average degree of ethoxylation of 2, marketed by KAO Chemicals Europe.

Detergent Compositions

Aqueous detergent compositions are preferred, comprising in the indicated amounts expressed as percentage by weight, a) 0.5%-10%, preferably between 1-7% of at least one alkyl ether carboxylate such as those previously described, b) 0.5%-10%, preferably between 1-7% of at least one amine oxide such as those previously described, c) 5%-40%, preferably between 10-35% of at least one alkyl ether sulfate such as those previously described, d) water up to 100%.

It is preferred that the ratio by weight between the alkyl ether sulfate (component c) and the alkyl ether carboxylate (component a) is comprised between 2:1 and 8:1, preferably between 2:1 and 5:1, more preferably between 2.5:1 and 4.5:1, even more preferably between 3.5:1 and 4.5:1.

It is also preferred that the ratio by weight between the alkyl ether sulfate (component c) and the amine oxide (component b) is comprised between 2:1 and 5:1, preferably between 2.5:1 and 5:1, more preferably between 3.5:1 and 5:1.

Finally, it is preferred that the ratio by weight between the alkyl ether carboxylate (component a) and the amine oxide (component b) is comprised between 1:3 and 3:1, preferably between 1:2 and 2:1, more preferably between 1:1 and 1.5:1.

The pH of the aqueous detergent compositions of the invention is preferably comprised between 6 and 8, preferably between 6.5 and 7.5.

The use of said detergent compositions for manual dishwashing or for cleaning hard surfaces, preferably for manual dishwashing, is also part of the object of the invention.

Another part of the object of the invention is the use of at least one alkyl ether carboxylate of formula (I)

$$R—O—(CH_2CH_2O)_m—CH_2—COOX \quad (I)$$

wherein

R represents a linear or branched, saturated or unsaturated alkyl or alkenyl group containing between 3 and 10 carbon atoms, m represents a number comprised between 0.5 and 20, and X represents hydrogen or a suitable cation, selected from an alkaline metal, an alkaline earth metal, ammonium, alkyl amino, alkanolamino or glucammonium, as a foaming amplifying or promoting agent in detergent compositions for manual dishwashing or in compositions for cleaning hard surfaces, preferably in detergent compositions for manual dishwashing.

The detergent compositions of the present invention can additionally contain one or more of the following additives, this list not being limited:

1. Anionic surfactants such as sodium alkyl ether sulfate, ammonium alkyl ether sulfate, triethanolamine alkyl ether sulfate, sodium alkyl sulfate, ammonium alkyl sulfate, triethanolamine alkyl sulfate, sodium alkyl sulfonate, sodium alkene sulfonate such as sodium alpha-olefin sulfonate, sodium alkane sulfonate, sodium alkyl aryl sulfonate such as alkyl benzene sulfonate, sulfosuccinates, and sulfosuccinamates.

2. Fatty acids or soaps derived from natural or synthetic substances such as coconut, oleic, soybean and tallow fatty acids.

3. Ethoxylated alcohols

4. Fatty acid esters derived from natural or synthetic substances such as glycol, ethylene glycol, diethylene glycol, propylene glycol, dipropylene glycol, sucrose, glucose or polyglycerin.

5. Ethoxylated fatty esters derived from hydroxy type fatty acids.

6. Amphoteric surfactants such as alkyl amidopropyl betaine, alkyl betaine, alkyl amidopropyl sulfobetaine, alkyl sulfobetaine, cocoamphoacetates and cocoamphodiacetates.

7. Amides such as monoethanolamides, diethanolamides, ethoxylated amides or alkylisopropanolamides.

8. Mixtures of alkoxylated glycerides and alkoxylated glycerin, marketed under the name LEVENOL® by KAO Chemicals Europe 9. Alkylpolyglycosides.

10. Cationic surfactants such as alkyl benzyl dimethyl ammonium halides, alkyl trimethyl ammonium halides, quaternized ethoxylated amines, esterquats derived from triethanolamine, methyldiethanolamine, dimethylaminopropanediol and oligomers of said esterquats.

11. Additives for improving said formulations such as thickeners, pearling agents, opacifying agents, preservatives, colorants or perfumes.

12. Calcium and/or magnesium ions (in the form of magnesium sulfate, magnesium chloride, magnesium carbonate, magnesium nitrate and magnesium acetate))

13. Protease and/or other enzymes such as cellulase, lipase, amylase, etc.

The following examples are set forth for the purpose of providing a sufficiently clear and complete explanation of the present invention to a person skilled in the art, but they must not be considered as limitations of the essential aspects of the object thereof, as they have been set forth in the previous sections of this description.

EXAMPLES

Example 1

Detergent Compositions for Manual Dishwashing

The detergent compositions for manual dishwashing of Table 1 were prepared.

TABLE 1

Detergent compositions for manual dishwashing (percentages by weight, representing 100% of active matter for each component)

| Components | A | B | C1 | C2 |
|---|---|---|---|---|
| Sodium lauryl ether sulfate[1] | 13.5 | 13.5 | 13.5 | 13.5 |
| Amine oxide[2] | 3.0 | 3.0 | 3.0 | 3.0 |
| $C_8$ alkyl ether carboxylic acid[3] | 3.5 | — | — | — |
| $C_6$-$C_8$ alkyl ether carboxylic acid[4] | — | 3.5 | — | — |
| Lauryl ether (4.5 EO) carboxylic acid[5] | — | — | 3.5 | — |
| Lauryl ether (10 EO) carboxylic acid[6] | — | — | — | 3.5 |
| Demineralized water | up to 100% | up to 100% | up to 100% | up to 100% |

[1]EMAL ® 270E (70% active matter and with an average degree of ethoxylation of 2) marketed by Kao Chemicals Europe
[2]OXIDET ® DMCL-D (coco alkyl dimethylamine oxide, 30% active matter) marketed by Kao Chemicals Europe
[3]AKYPO ® LF1 (capryl ether carboxylic acid with an average degree of ethoxylation of 5, 90% active matter) marketed by Kao Chemicals Europe
[4]AKYPO ® LF4 (mixture of capryl ether carboxylic acid with an average degree of ethoxylation of 8 and caproyl ether carboxylic acid with an average degree of ethoxylation of 3, 89% active matter) marketed by Kao Chemicals Europe
[5]AKYPO ® RLM45 CA (Lauryl ether carboxylic acid with an average degree of ethoxylation of 4.5, 92% active matter)
[6]AKYPO ® RLM100 (Lauryl ether carboxylic acid with an average degree of ethoxylation of 10, 90% active matter)

The evaluation of the different compositions was carried out from the determination of the foaming power in the presence of grease (olive oil) according to the following process.

The foam volume of an aqueous solution of the product to be tested at a concentration of 0.4 g/L (active product), at water hardness of 20° HF (French degrees) and at a temperature of 40° C., was determined.

The measurements were carried out using a "SITA Foam Tester R-2000" stirrer (supplied by SITA Messtechnik GmbH), working at 1500 rpm, with 10-seconds stirring cycles.

The foam volume was measured and 50 μL of grease (olive oil) were added between each stirring cycle.

A parabolic type curve is obtained when the foam volume (coordinates) is represented against the number of oil additions (abscissa), with a maximum foam value.

The following curve parameters are considered to compare the behavior of the different products:

Maximum foam volume: maximum point of the curve

Number of theoretical plates: abscissa intercept (number of oil additions) corresponding to a foam volume of 100 mL The results of the evaluation are shown in Table 2.

TABLE 2

| Evaluation of the detergent compositions for manual dishwashing | | |
|---|---|---|
| Detergent compositions | Maximum foam volume (mL) | Number of theoretical plates |
| A | 820 | 60 |
| B | 840 | 61 |
| C1 | 512 | 43 |
| C2 | 426 | 37 |

The detergent compositions for manual dishwashing according to the invention (A-B) have both a maximum foam volume and a number of theoretical plates greater than those of the detergent compositions for washing dishes of the comparative examples (C1-C2), including alkyl ether carboxylates with a lauric chain.

The invention claimed is:

1. A clear aqueous detergent composition comprising the following elements in the indicated amounts expressed as percentage by weight:

a) 0.1-15% of at least one alkyl ether carboxylate of formula (I)

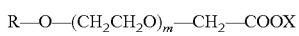

$$R—O—(CH_2CH_2O)_m—CH_2—COOX \quad (I)$$

wherein

R represents a linear or branched, saturated or unsaturated alkyl or alkenyl group containing between 5 and 9 carbon atoms, m represents a number comprised between 0.5 and 20, and X represents hydrogen or a suitable cation, selected from an alkaline metal, an alkaline earth metal, ammonium, alkyl amino, alkanolamino or glucammonium, b) 0.1-15% of at least one amine oxide of formula

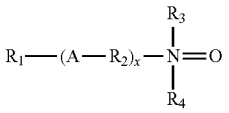

$$R_1—(A—R_2)_x—N(R_3)(R_4)=O \quad (II)$$

wherein $R_1$ represents a linear or branched, saturated or unsaturated alkyl or alkenyl group containing between 8 and 18 carbon atoms, $R_2$ represents an alkylene group containing between 1 and 6 carbon atoms, A represents a group selected from —COO—, —CONH—, —OC(O)— and —NHCO—, x represents 0 or 1, and $R_3$ and $R_4$ independently of one another represent an alkyl or hydroxyalkyl group containing between 1 and 3 carbon atoms, c) 0.1-40% of at least one alkyl ether sulfate anionic surfactant with a hydrocarbon chain containing between 10 and 18 carbon atoms, and d) water up to 100%; and wherein the ratio by weight between the alkyl ether sulfate (c) and the amine oxide (b) is between 2:1 and 5:1.

2. The composition according to claim 1, characterized in that in the alkyl ether carboxylates of formula (I) R represents a linear or branched, saturated or unsaturated alkyl or alkenyl group of 6 to 8 carbon atoms.

3. The composition according to claim 1, characterized in that in the alkyl ether carboxylates of formula (I) m represents an integer between 1 and 15.

4. The composition according to claim 1, characterized in that in the alkyl ether carboxylates of formula (I) X represents hydrogen or an alkaline metal.

5. The composition according to claim 1, characterized in that in the amine oxide of formula (II), $R_1$ represents a linear or branched, saturated or unsaturated alkyl or alkenyl group containing between 10 and 16 carbon atoms.

6. The composition according to claim 1, characterized in that in the amine oxide of formula (II), A represents —COO— or —CONH—.

7. The composition according to claim 1, characterized in that the anionic surfactant or surfactants are selected from sodium alkyl ether sulfates with an alkyl or alkenyl chain containing between 10 and 18 carbon atoms and with an average degree of ethoxylation comprised between 0.5 and 7.

8. The composition according to claim 7, characterized in that the sodium alkyl ether sulfate or sulfates present an alkyl or alkenyl chain containing between 12 and 16 carbon atoms and with an average degree of ethoxylation comprised between 1 and 5.

9. The composition according to claim 1, characterized in that the anionic surfactant is sodium lauryl ether sulfate, with an average degree of ethoxylation comprised between 1 and 3.

10. The composition according to claim 1, characterized in that it comprises, in the indicated amounts expressed as percentage by weight, a) 0.5%-10% of at least one alkyl ether carboxylate of formula (I), b) 0.5%-10% of at least one amine oxide of formula (II), c) 5%-40% of at least one alkyl ether sulfate, d) water up to 100%.

11. A method for manual dishwashing or cleaning a hard surface comprising contacting the hard surface or dish with a composition as defined in claim 1.

12. The composition according to claim 2, wherein the at least one alkyl ether carboxylate is a $C_6$-$C_8$ alkyl ether carboxylic acid.

13. The composition according to claim 10, comprising, indicated amounts expressed as percentage by weight, a) 1-7% of the at least one alkyl ether carboxylate of formula (I), b) 1-7% of the at least one amine oxide of formula (II), c) 10-35% of the at least one alkyl ether sulfate, and d) water up to 100%.

14. The composition according to claim 13, wherein in the at least one alkyl ether carboxylate of formula (I), R represents a linear or branched, saturated or unsaturated alkyl or alkenyl group of 6 to 8 carbon atoms.

15. The composition according to claim 14, wherein in the at least one alkyl ether carboxylates of formula (I), m represents an integer between 1 and 15, and X represents hydrogen or an alkaline metal; and and wherein the alkyl ether sulfate is sodium alkyl ether sulfate with an alkyl or alkenyl chain containing between 10 and 18 carbon atoms and with an average degree of ethoxylation between 0.5 and 7.

16. The composition according to claim 15, wherein in the at least one amine oxide of formula (II), $R_1$ represents a linear or branched, saturated or unsaturated alkyl or alkenyl group containing between 10 and 16 carbon atoms, and A represents —COO— or —CONH—; and wherein the sodium alkyl ether sulfate presents an alkyl or alkenyl chain containing between 12 and 16 carbon atoms and having an average degree of ethoxylation between 1 and 5.

17. The composition according to claim 16, wherein the at least one alkyl ether carboxylate is a $C_6$-$C_8$ alkyl ether carboxylic acid.

18. The composition according to claim 1, wherein the ratio by weight between the alkyl ether sulfate (c) and the amine oxide (b) is between 2.5:1 and 5:1.

19. The composition according to claim 18, wherein the ratio by weight between the alkyl ether sulfate (c) and the amine oxide (b) is between 3.5:1 and 5:1.

* * * * *